United States Patent [19]

Reams et al.

[11] 4,096,695

[45] Jun. 27, 1978

[54] ENGINE DRIVEN HEATING SYSTEM COMPONENTS FOR STIRLING ENGINES

[75] Inventors: Lowell A. Reams, Plymouth; Andrew E. Geddes, Detroit, both of Mich.

[73] Assignee: Ford Motor Company, Dearborn, Mich.

[21] Appl. No.: 774,074

[22] Filed: Mar. 3, 1977

[51] Int. Cl.[2] ..... F02G 1/04

[52] U.S. Cl. ..... 60/517; 60/656; 60/718; 74/166

[58] Field of Search ..... 60/517, 525, 656, 698, 60/716, 717, 718, 720; 74/166

[56] References Cited

U.S. PATENT DOCUMENTS 4,020,634 5/1977 Bradley ..... 60/517

*Primary Examiner*—Allen M. Ostrager

*Attorney, Agent, or Firm*—Joseph W. Malleck; Olin B. Johnson

[57] ABSTRACT

A mechanical drive system permits a single electric motor to drive at least three rotary components necessary to the cold starting of a Stirling engine. These components comprise a rotary preheater, an air atominzng pump for facilitaing proper injection of fuel particle size, and a combustion air blower, all necessary to heat the working gas of a Stirling engine prior to engine cranking. The drive system employs a shaft, offset from the engine driven element but drivingly connected thereto. A clutch is interposed between the offset shaft and the rotary starting components, as well as between the electric motor drive and said components. Thus, drive is alternatively transmitted, first from said motor to the component to permit engine temperature increase, cranking is then established, and then drive is transmitted from the engine driven element to said components.

5 Claims, 2 Drawing Figures

ENGINE DRIVEN HEATING SYSTEM COMPONENTS FOR STIRLING ENGINES

BACKGROUND OF THE INVENTION

The internal working gas system of a Stirling engine receives energy from an external combustion system. The two systems are highly interdependent at normal operating conditions, the internal system driving an output member which in turn drives movable components of the external system which again in turn actuates the internal system. However, during engine starting from a cold condition, the internal working fluid must be heated prior to engine cranking and brought up to higher temperatures. To this end, the external combustion system must somehow be brought into operation and this requires rotation of said several movable components, such as a rotary preheater, an air atomizing pump and a combustion air blower before the engine "turns over".

With the present state of the art for Stirling engines useful for vehicles, movable components of the external combustion system are each separately operated by an electrical motor during engine starting conditions. This is principally necessitated by the varying speed requirements of each of the movable components not only during engine starting conditions but also during elevated operating speed ranges. Since the movable components are widely separated at varying locations about the engine body, separate motors are demanded. Once the engine has developed sufficient speed and is able to provide sufficient auxiliary drive for such components, the presently known Stirling engines do not deactivate the electric motors driving the air pump and preheater. Only the combustion air blower will be engine driven after the engine has been started.

Several problems are presented by this state of the Stirling engine art, among which include: (a) a reduced overall drive efficiency for the electric driven combustion components, (b) a reduced engine fuel economy due to the lack of engine driven preheater and air pump components, (c) an increased difficulty in packaging the overall engine system within a smaller silhouette of the engine compartment due to the existence of numerous electric motors surrounding the engine body, and (d) prevents the driving of additional accessories without the employment of further independent electric motors, particularly when such accessories are located both front and rear of the engine.

SUMMARY OF THE INVENTION

The primary object of this invention is to provide an improved drive system which smoothly receives and transfers power alternatively from a single source of auxiliary electrical power and from the mechanically driven element of the engine, said system connecting with a plurality of components necessary for operation of the external combustion system of the engine.

Still another object of this invention is to provide a Stirling engine which has reduced weight and lower cost over that of conventional Stirling engines, and has an improved drive system which accommodates starting the engine from a cold condition as well as driving said system by the engine itself, said drive system conveniently providing for the accommodation of additional engine driven accessories, if necessary.

Still another object of this invention is to provide a Stirling engine of the type that has at least three components necessary for driving the external combustion system, said components being driven by a single source of electrical energy during a cold start condition and progressively driven by the output member of the engine when operating temperature conditions are reached, each of said components being driven at different speed ranges which vary from that of the engine driven element.

Specific features pursuant to the above objects comprise: (a) the use of a single electrical motor mounted at the side of the Stirling engine, a take-off shaft which is offset from the centerline of the engine and is drivingly connected to the output of said engine, a hollow driven shaft concentrically disposed about said offset shaft, a viscous one-way clutch means interposed between the hollow shaft and the take-off shaft to provide for an increasing difference in speed ratio between the hollow shaft and the take-off shaft, and means connecting the single source of electrical power to the hollow shaft by way of a one way means adapted to transmit power congruent to the power transmitted through said viscous one-way clutch.

DETAILED DESCRIPTION

Figure 1:
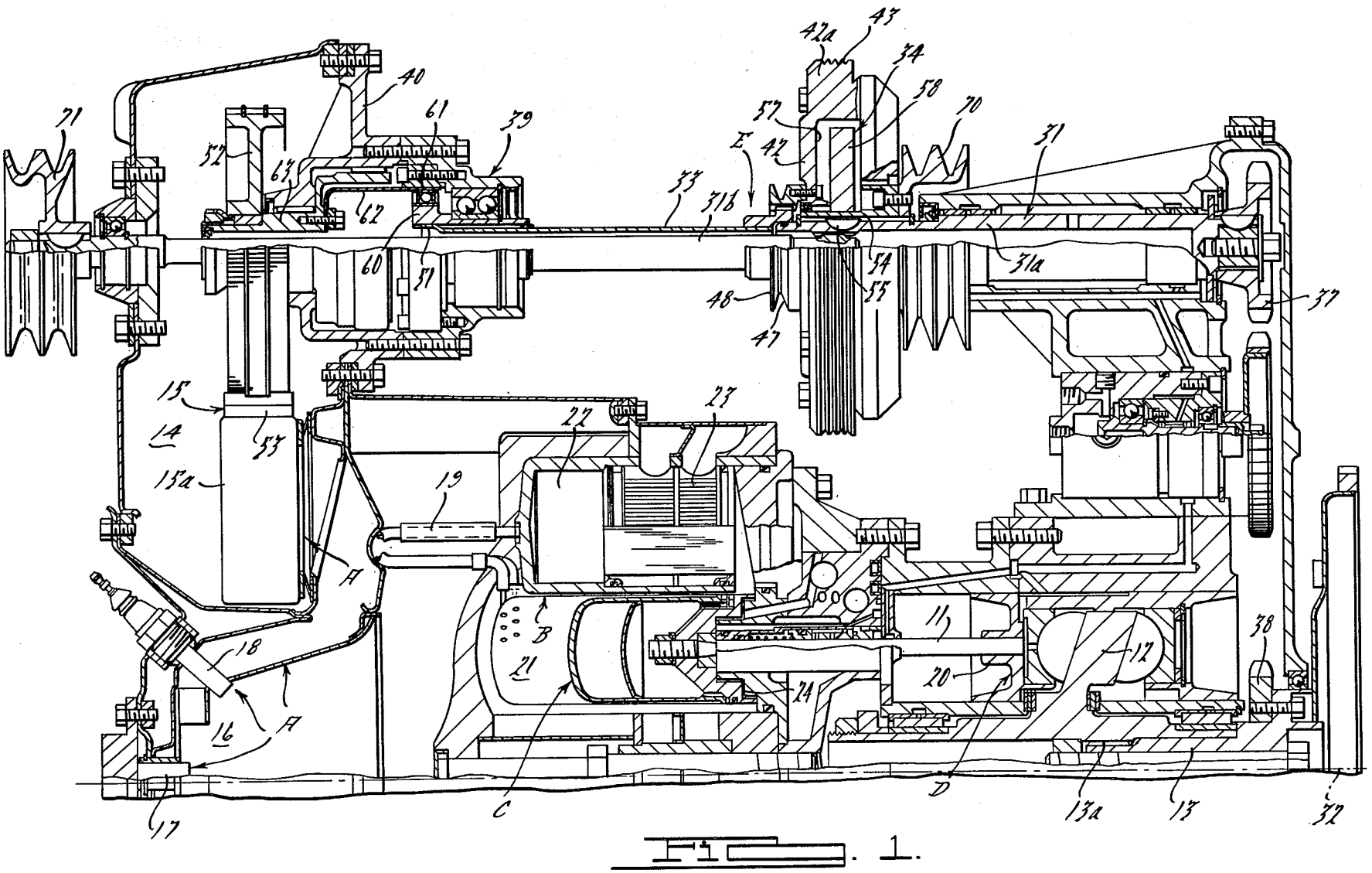
FIG. 1 is a sectional elevational view of a Stirling engine embodying the principles of this invention, part of said view being sectioned along a central plane and the other part of said view being sectioned along a rear plane, and some of the components being shown schematically.

As shown in FIG. 1, a Stirling engine with which this invention is concerned, broadly comprises an external combustion system A which is effective to transfer energy to an internal working fluid system B, the internal working fluid system being connected to double acting piston elements C which in turn are connected by rods 11 to an output assembly D comprising a rotary swashplate 12 effective to convert reciprocal motion into rotary motion. A driven element 13 is drivingly connected to the swashplate at 13*a* and operates as the output member of the engine.

In more particularity, the external combustion system A comprises an air induction channel 14 which receives air forced by an air blower (not shown); the inducted air is directed through one sector 15*a* of a rotating preheating wheel 15 which has been previously heated by exhaust gases in another station. The preheated air is thus conducted to a combustion chamber 16 within which a fuel is injected in a predetermined proportion, the fuel being injected by an air atomizer 17 effective to control the influx of fuel thereto. The combustible mixture is ignited by suitable sparking means 18 and the combusted gases are then caused to migrate about the heater tube assembly 19 of the internal working fluid system B; after the combusted gases have transferred heat to the tube assembly, they are directed to pass through the preheater wheel and are vented to an exhaust system.

The internal working fluid system B employs said plurality of double-acting pistons C operating in a known manner, each being connected to a crosshead 20 attached to the rotary swashplate 12. The double-acting pistons are exposed to a hot chamber 21 at one end thereof, the hot chamber being in communication with the maze of heater tubes 19 extending through said external combustion system. The heater tubes are, in turn, connected to a regenerator 22 and cooler system 23 which in series connects with a cold chamber 24 exposed to the opposite end of an adjacent piston.

For purposes of cold starting of the engine, a series of combustion circuit components must be energized, including the rotary preheater 15, the pump for the air atomizer 17 useful for injecting air to carry the fuel into the combustion chamber and the rotary air blower. Since the engine does not provide immediate output power during a cold start condition, no power can be taken off of the driven element for powering the components necessary for starting. An independent source of rotary motion must be supplied and this has typically been provided through a series of independent and separate electrical motors connected to each one of said external combustion circuit components.

The invention herein comprises a drive system E which provides for reversable drive from first a single source of electrical energy 30 and secondly from the driven element 13 of the engine. This provides rotary power which is stepped down proportionally from the speed of the driven element to provide rotary power more in line with each of the needs of the various components.

Figure 2:
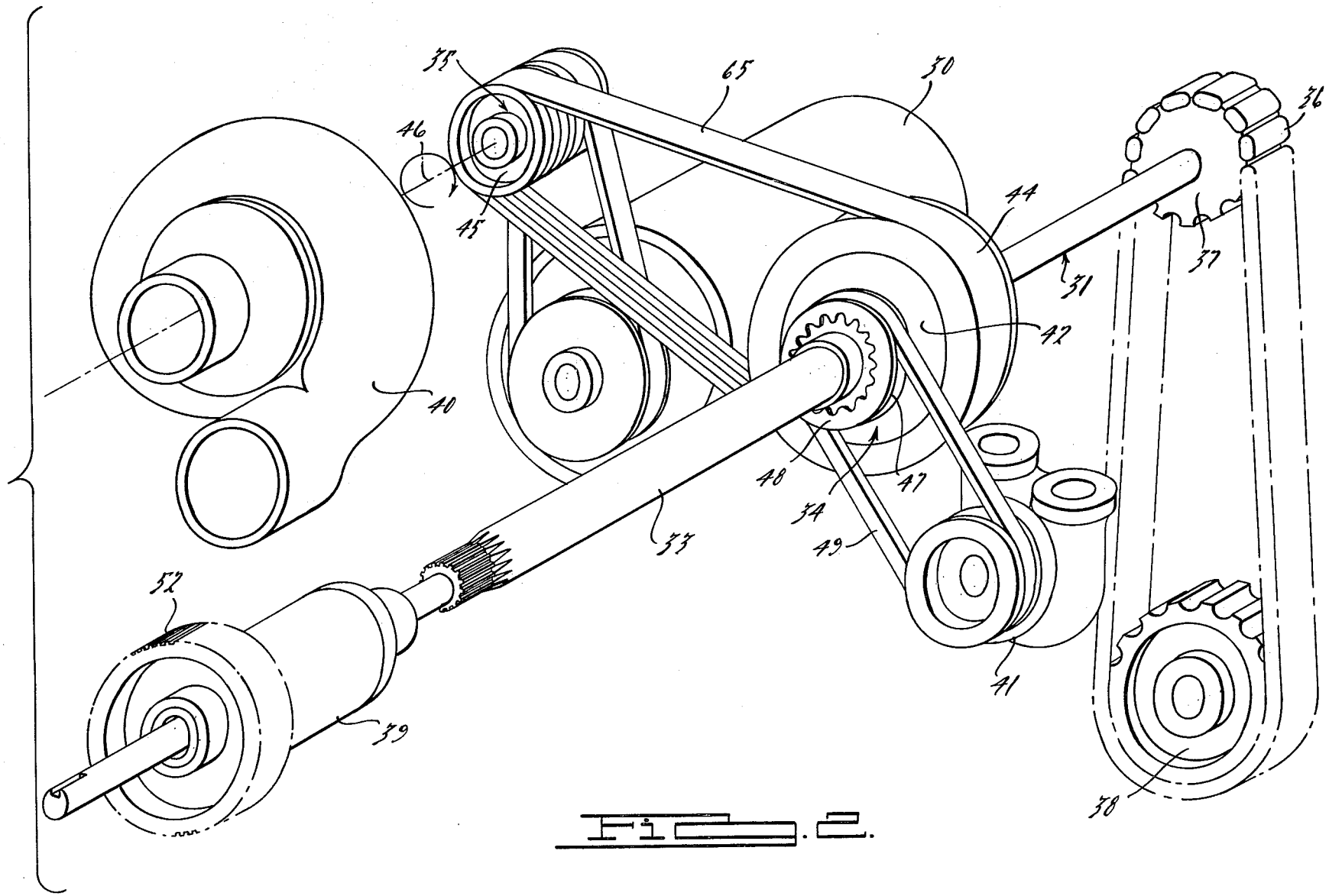
FIG. 2 is an enlarged perspective view of certain components of the structure illustrated in FIG. 1, depicting the drive system of this invention.

As shown in FIGS. 1 and 2, the driven system E comprises an electrical motor 30, a first shaft 31 offset from the centerline 32 of the engine, a second shaft 33 concentrically disposed about the first shaft, means 34 for providing a viscous drive connection between the first and second shaft 33 and the motor 30 whereby drive may be transmitted either from said motor or first shaft 31 to said second shaft 33 in the same rotative direction.

The first shaft 31 is located in a position as illustrated in FIG. 1, driven by a chain 36, as shown in FIG. 2, operably connecting an accessory drive sprocket 37 connected to said first shaft 31 and a chain driven sprocket 38 connected to the driven element 13 of the engine. The first shaft 31 is preferably formed with telescoping portions, a first portion 31*a* which extends into the viscous drive means 34 and another portion 31*b* is partly received internally within said first portion 31*a*, the latter extending through a harmonic drive mechanism 39 and housing 40 adjacent the rotating preheating element 15.

The rotative motion transferred through to the various external combustion circuit components (preheater 15, air blower 40, and air atomizer pump 41) is varied in speed in accordance with the speed of structure 34 connected to the concentric shaft. Firstly, an output element 42 of the viscous drive has on its outer periphery 42*a* thereof a suitable sprocket 43 for carrying a pulley 44, said pulley extending to a sprocket 45 on another offset shaft 46. A smaller pulley groove 47 is provided on a stepped down portion 48 of said output element 42 and is adapted to receive a second pulley 49 which may extend from said stepped portion 48 to an air pump sprocket 50 effective to drive the atomizing air pump 41 as shown in FIG. 2.

At a remote end of the second shaft 33, a suitable connection 51 is provided between said second shaft 33 and a harmonic drive gear box 39 which in turn transmits rotative power of a specific speed ratio to a pinion gear 52; the gear 52 is in mesh with the annular ring gear 53 of the preheater wheel 15.

The viscous drive clutch 34 is comprised of an input element 54 which is drivingly connected by a spline connection 55 to the first shaft portion 31*a*; the input element 54 has suitable vanes thereon so that the surrounding output element 42, which forms a closed fluid chamber about the first element, is driven by a viscous fluid connection between the side surfaces 57 and 58, the relative motion therebetween becoming differentially greater as the speed of the input element increases. The output element 42 is comprised of first and second discs which are rotatively and sealingly supported about the first shaft 31.

The harmonic gear box 39 is comprised of a housing having a sun gear 60 drivingly connected to a ring gear 61 on a concentric hollow output member 62, said sun gear 60 having a predetermined number of gear teeth N. The output member, is preferably shaped as a hollow drum, said drum supporting said ring gear 61; the ring gear has a predetermined number of teeth, preferably N + 1 or 2, so that a drive ratio of slightly less than 1 to 1 is achieved. The output member has a central hub 63 which extends through the housing 40 supporting the harmonic gear box. The hub 63 supports the gear 52 adapted to mesh with the exterior ring gear 53 of the preheater wheel. The harmonic gear box is supported in a wall of the housing 40 which extends along a radial plane of the engine and which is perpendicular to the centerline 32.

The mode of operation for the preferred embodiment is as follows. Upon energization of the electrical motor by closing the ignition circuit, the motor 30 will drive the inner race of a one-way clutch 45 so that the clutch will engage and provide rotative drive (in the direction as indicated in FIG. 2 through a shaft 46 to blower 40 and through pulley 65 to the viscous clutch sprocket 42. The sprocket 42 is, in turn, mechanically connected to sprocket 48 for the pulley system leading to the air atomizing pump and also connected by way of hollow shaft 33 and harmonic gear box 39 to the spur gear 52 driving the preheater. Each of the rotary elements of said accessory components (40, 41 and 15) are driven in the same rotative direction and at a speed appropriate for the specific component while at engine starting condition. Thus, the preheater wheels immediately turns and the blower immediately begins to compress and induct air; the entire external heating circuit is cleared of residual gases by virtue of ambient air being positively driven through the entire system for approximately a four second period. A delay element (not shown) prevents introduction of fuel through atomizer 17 and spark until after this four second period, after which the temperature in the engine heater head rises. When engine temperature, such as in spaces 21, reaches 600°-625° C, power is transmitted from an electric motor to crank the engine transmission and thus the output element 13. When the output member reaches 400 r.p.m., the cranking is withdrawn. When the engine heater head temperature reaches 675° C, the motor 30 is de-energized; output element 13 is now being driven by the thermal cycling of the engine. The power flow thus changes so that output element transmits drive through chain 36, to shaft 31 and through viscous clutch 34 to the three components 40, 41 and 15. Upon reaching the temperature of 675° C, the driven element 13 will have succeeded in achieving an output speed of approximately 600 r.p.m.

Additional power may be taken from the shaft 31*a*, rearwardly shaft 31*b* forwardly of the engine, facilitated by the unique construction herein. Sprocket 70 is attached to the input element 54 of the viscous clutch 34 and is in a substantial rearward position. Sprocket 71 is drivingly carried by the forward end of shaft portion **31*b* which extends entirely through shaft 33 thru gear box 39 and out through the front of housing 40. This is quite advantageous, since both pure engine driven components (additional power take-off) and the starting components (preheater 15, air blower 40 and air atomizer pump 41**) can be driven from same source shaft without additional shafts as now required in the engine art today.

We claim:

1. A two power-source drive system for use in a Stirling engine having a longitudinally extending centerline and an engine driven element coincident therewith providing one power source, comprising:

(a) an electrically energized motor providing a second power source, (b) a first shaft offset but aligned with said centerline, said first shaft being drivingly connected to said driven element, (c) a second shaft concentrically disposed about said first shaft, (d) means providing a viscous drive connection between said first and second shafts, (e) a plurality of combustion circuit components for said engine, each of said components being connected to said second shaft, and (f) means providing a one-way driven connection between said second shaft and motor whereby drive may be transmitted either from said motor or first shaft to said second shaft in the same rotative direction.

2. A drive system as in claim 1, in which said combustion circuit components comprise a rotary preheater, an air atomizer having a rotating pump element and an air blower having a rotatable compressive element, the connection between said preheater and second shaft comprising a fixed speed ratio harmonic drive mechanism.

3. A drive system as in claim 1, in which said first shaft comprises telescoping first and second portions, said first portion being connected to said engine driven element and said second portion entirely extending through said second shaft whereby additional rotatable accessories may be connected for drive.

4. The drive system as in claim 3, in which said engine has additional rotatable accessory drive components and in which said first portion has means offset therefrom effective to extend rearwardly of the engine and transmit drive to said additional accessory rotatable drive components.

5. A two power-source drive system for use in a Stirling engine having a longitudinally extending centerline and an engine driven element coincident therewith providing one power source, comprising:

(a) an electrically energized motor providing a second power source, (b) a first shaft offset but aligned with said centerline, said first shaft being drivingly connected to said driven element, said first shaft having first and second portions, the first portion being connected to said engine driven element and said second portion extending entirely through said second shaft whereby additional rotatable accessories are connected for engine drive foreward of said engine, said first portion has means thereon effective to extend rearwardly and transmit drive to additional rotatable accessories for engine drive rearward of said second portion, (c) a second shaft concentrically disposed about said first shaft, (d) means providing a viscous drive connection between said first and second shafts, (e) a plurality of combustion circuit components for said engine, each of said components being connected to said second shaft, and (f) means providing a one-way driven connection between said second shaft and motor whereby drive may be transmitted either from said motor or first shaft to said second shaft in the same rotative direction.

* * * * *